US007445352B2

(12) United States Patent
Lin

(10) Patent No.: US 7,445,352 B2
(45) Date of Patent: Nov. 4, 2008

(54) UNDERWATER LIGHT

(76) Inventor: Yuan Lin, 3F, No. 16, Sec. 2, Jhongyang South Road, Taipei City (TW)

( * ) Notice: Subject to any disclaimer, the term of this patent is extended or adjusted under 35 U.S.C. 154(b) by 0 days.

(21) Appl. No.: 11/730,357

(22) Filed: Mar. 30, 2007

(65) Prior Publication Data

US 2008/0239704 A1 Oct. 2, 2008

(51) Int. Cl.
*F21V 33/00* (2006.01)

(52) U.S. Cl. ..... 362/101; 362/96; 362/267

(58) Field of Classification Search ..... 362/96, 362/101, 154, 240–246, 306, 310, 374, 375, 362/800, 267; 439/416, 422, 270–277
See application file for complete search history.

(56) References Cited

U.S. PATENT DOCUMENTS 6,174,067 B1 * 1/2001 Thrasher et al. ..... 362/101
6,315,429 B1 * 11/2001 Grandolfo ..... 362/158
6,379,025 B1 * 4/2002 Mateescu et al. ..... 362/293
7,125,146 B2 * 10/2006 Willis et al. ..... 362/267
7,303,301 B2 * 12/2007 Koren et al. ..... 362/101

* cited by examiner

*Primary Examiner*—Hargobind S Sawhney
(74) *Attorney, Agent, or Firm*—Apex Juris, pllc; Tracy M Heims

(57) ABSTRACT

An underwater light generally has a base having a light source housing chamber and a bottom tunnel. The base has at least two screw holes communicating the light source housing chamber with the bottom tunnel. A substrate for a light-emitting device is disposed in the light source housing chamber. A reflection cover is disposed over the substrate. A watertight upper cover is disposed over the reflection cover, and coupled to the upper edge of the light source housing chamber. The screw holes are connected respectively with two watertight walls to allow the insertion thereinto of at least two screw devices. A power strip is clamped in the bottom tunnel by a bottom plate to enable the watertight walls to pierce through an insulating casing of the power strip for electrifying the screw devices, whereby the underwater light has a stable power source and an excellent property of watertightness.

8 Claims, 4 Drawing Sheets

UNDERWATER LIGHT

FIELD OF THE INVENTION

The present invention relates to an excellently watertight, highly stable underwater light to be suitable for use in swimming pools, water pools, aquariums and fountains.

BACKGROUND OF THE INVENTION

Nowadays, the products such as candy, crackers and gift boxes are laid stress on their packages. In addition, for the purpose of creating more features and pleasant scenes to attract many tourists or pleasure the owners or other people, many colorful and beautiful decorative lights adaptable to beautify the appearance at night time are applied to scenic spots, residential environments and public places.

Among such decorative landscape lights, which are applied to water dance and pools, the underwater lights are applied to the swimming pools, the water pools, the aquariums and the fountains. There is an increased tendency to apply the light-emitting diode, which acts as the light source, to the underwater light. The light-emitting diode has long durability and lifetime and low power consumption. In addition, the light-emitting diode has gained increasing requirement and acceptance in the market because of it ability to emit red, green and blue lights to generate gorgeous color effect. However, a largest potential issue for the underwater light is the problem of water penetration. The underwater light that has a good watertight structure can extend the lifetime of the light-emitting diode. In addition, the light-emitting diode must be equipped with the power source to be supplied with electric power so the wiring of the power wires must have a good property of watertightness.

The commercial underwater light usually has poor electrical conduction as mounted under water or usually suffers from electrical conduction troubles caused by water penetration after long-term use. Accordingly, according to the motive of the present invention, the present inventor makes diligent studies in providing consumers with an underwater light capable of overcoming the electrical conduction failure caused by water penetration.

SUMMARY OF THE INVENTION

It is a major object of the present invention to provide an excellently watertight, highly stable underwater light that mounts watertight walls on screw holes to provide stable electric power for preventing the generation of current leakage or poor electrical conduction caused by contact between power wires and water when mounted underwater.

In order to achieve the foregoing object, the present invention discloses an underwater light, which generally has a base having a light source housing chamber and a bottom tunnel. The base has at least two screw holes that communicate the light source housing chamber with the bottom tunnel. A substrate for a light-emitting device is disposed in the light source housing chamber. A reflection cover is disposed over the substrate. A watertight upper cover is disposed over the reflection cover, and coupled to the upper edge of the light source housing chamber. The screw holes are located to pierce through the bottom tunnel, and connected respectively with two watertight walls to allow the insertion thereinto of at least two screw devices. A power strip is clamped in the bottom tunnel by a bottom plate to enable the watertight walls to pierce through an insulating casing of the power strip for electrifying the screw devices, whereby the underwater light has a stable power source and an excellent property of watertightness.

The aforementioned and other objects and advantages of the present invention will be readily clarified in the description of the preferred embodiments and the enclosed drawings of the present invention.

DETAILED DESCRIPTION OF THE PREFERRED EMBODIMENT

Figure 1:
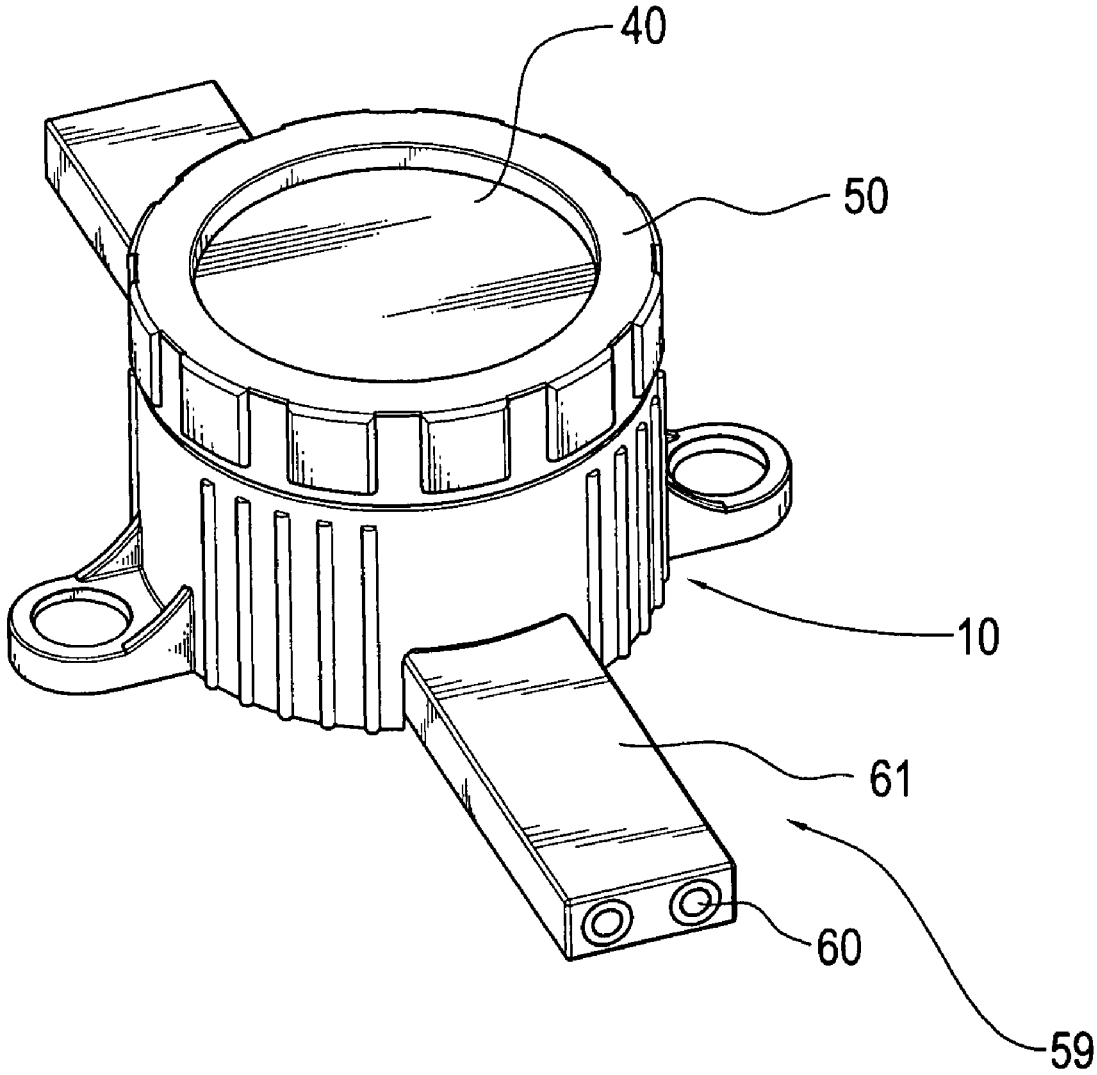
FIG. 1 is a perspective view of the present invention.
Figure 2:
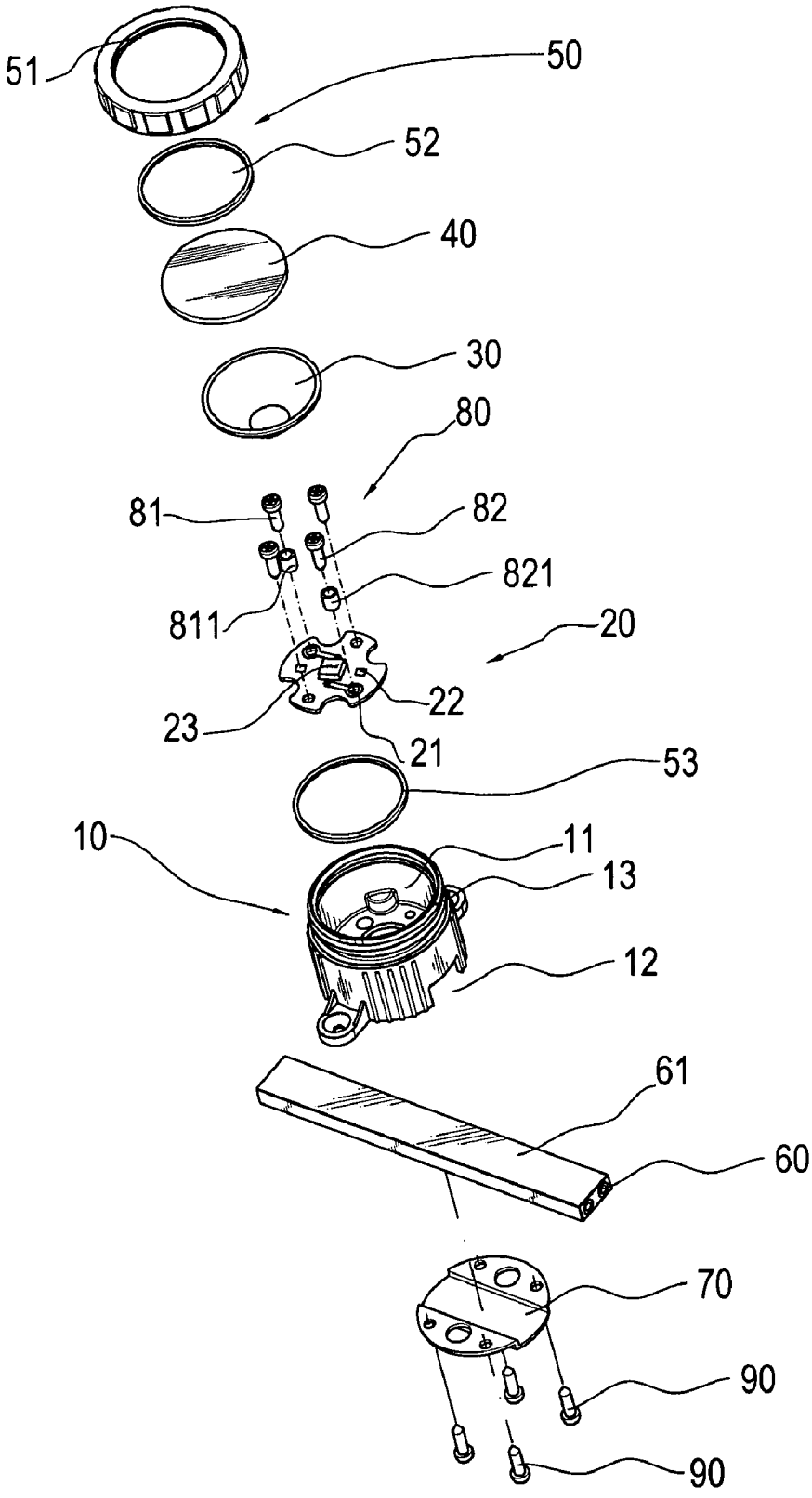
FIG. 2 is a perspective, decomposed view of the present invention.
Figure 3:
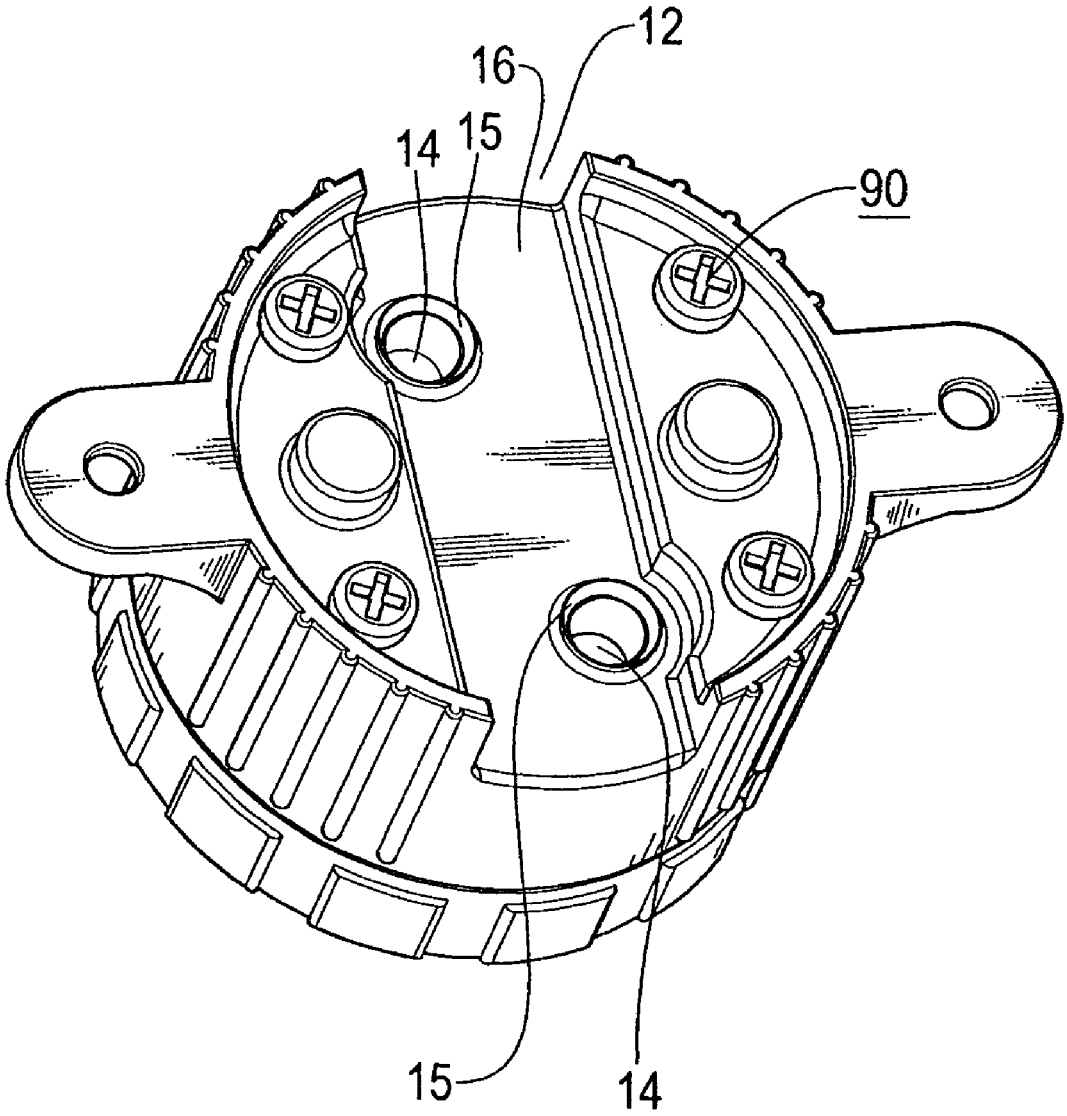
FIG. 3 is a schematic diagram showing the base of the underwater light of the present invention.

Referring to FIGS. 1 through 3, an underwater light of the present invention comprises a base 10, a substrate 20 carrying a light-emitting device, a reflection cover 30, a watertight upper cover 50, a power strip 59, a bottom plate 70 and at least two screw devices 80. The base 10 has a light source housing chamber 11 and a bottom tunnel 12. At least two screw holes 14 are formed inside the light source housing chamber 11 to communicate with the bottom tunnel 12, wherein two screw holes are utilized in this preferred embodiment. In addition, a coupling part 13 is mounted on the upper edge of the light source housing chamber 11. The substrate 20 is mounted on the inside of the light source housing chamber 11 of the base 10. In addition, the substrate 20 has a connection circuit 21, an electronic device 22 and at least one light-emitting device mounted thereon. The light-emitting device is such as a light-emitting diode 23 or a light bulb. The reflection cover 30 is located over the substrate 20 for gathering the light beams emitted from the at least one light-emitting device. The watertight upper cover 50 is located over the reflection cover 30. In addition, the watertight upper cover 50 has a watertight cap 40, which is made of a transparent material such as glass or plastic, to insulate the light source housing chamber 11 of the base 10 from water. The watertight upper cover 50 is coupled to the upper edge of the light source housing chamber 11, and it has a corresponding coupling part 51 to be coupled to the upper edge of the light source housing chamber 11. Two sealing gaskets 52, 53 are optionally disposed on the connection portions of the watertight upper cover 50 to dispose the watertight upper cover 50 on the base 10 tightly. The bottom tunnel 12 has a slot 16 formed therein. In addition, the screw holes 14 that communicate with the bottom tunnel 12 also have respective watertight walls 15 disposed thereon for screwing thereinto of two screw devices 81, 82. The power strip 59 is utilized for supplying the electric power for the substrate 20, and the power strip 59 is coated with an insulating casing 61. The bottom plate 70 is screwed inside the bottom tunnel 12. In addition, the power strip 59 is clamped into the slot 16 of the bottom tunnel 12 by the bottom plate 70 to enable the watertight walls 15 on the screw holes 14 to pierce through the insulating casing 61 of the power strip 59 and the screw holes 14 provide the screw devices 81, 82 screwed therein to pierce through the insulating casing 61 of the power strip 59 and electrically connect with the power wire 60. The at least two screw devices 80 are utilized to fix the substrate 20 in the base 10. In addition, the screw devices 81, 82 are connected to a positive electrode and a negative electrode of the substrate 20, respectively, and they have two insulating bushes 811, 821 disposed thereon, respectively. The screw devices 81, 82 are electrically connected to power wires 60 of the power strip 59 by respectively passing through the screw holes 14 of the bottom tunnel 12 of the base 10.

For the purpose of assembling the above-mentioned components of the underwater light, the power strip 59 is first disposed in the slot 16 of the bottom tunnel 12 of the base 10, and then screw devices 90 are utilized to screw the bottom plate 70 onto the base 10. At this moment, the insulating casing 61 of the power strip 59 is pierced by the watertight walls 15 on the bottom tunnel 12. Next, the substrate 20 is disposed in the light source housing chamber 11 of the base 10. Next, the at least two screw devices 80 are utilized to screw the substrate 20 onto the base 10, wherein four screw devices 80 are utilized in this preferred embodiment. Next, the reflection cover 30 is disposed in the light source housing chamber 11, and the sealing gasket 53 is disposed on the bottom of the coupling part 13 mounted on the upper edge of the light source housing chamber 11. The sealing gasket 52 is disposed inside the corresponding coupling part 51 of the watertight upper cover 50. Finally, the watertight upper cover 50 is coupled to the coupling part 13 mounted on the upper edge of the light source housing chamber 11 to complete this underwater light.

Figure 4:
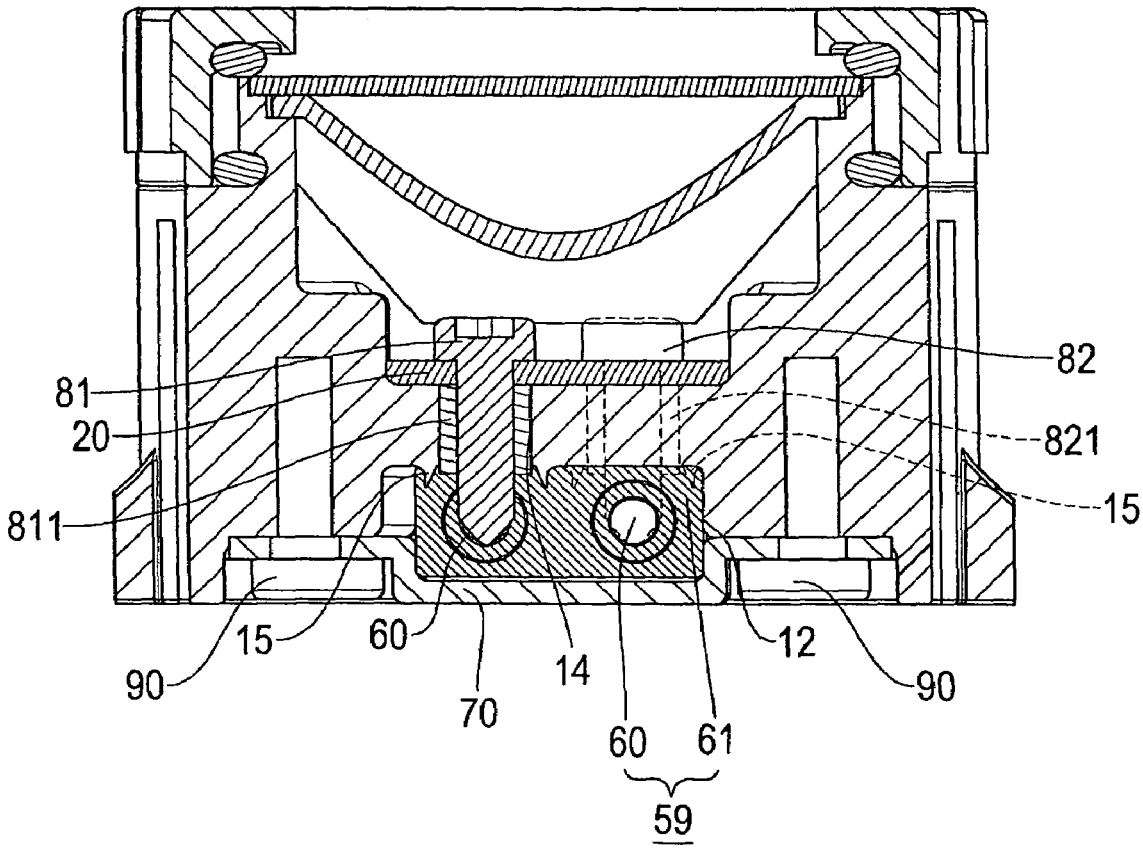
FIG. 4 is schematic, cross-sectional view of the present invention in assembled configuration.

The screw devices 81, 82, which are electrically connected to the substrate 20, are electrically connected to the power wires 60 by passing through the screw holes 14 formed in the slot 16 of the bottom tunnel 12 of the base 10, respectively. As a result, referring further to FIG. 4, after screwing the bottom plate 70 onto the base 10, the screw devices 81, 82 can pierce through the insulating casing 61 of the power strip 59 to be electrically connected to the power wires 60. In addition, the screw holes 14 that pierce through the bottom tunnel 12 are connected with the watertight walls 15. Such watertight walls 15 and insulating casing 61 provide the connection portions between the screw devices 81, 82 and the power wires 60 with an excellent property of watertightness, thereby providing the underwater light with a stable power source and an excellent property of watertightness.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

To sum up, the underwater light of the present invention is capable of achieving the anticipated performance described above. Therefore, this application is filed according to the patent law.

What is claimed is:

1. An underwater light, comprising:

a base having a light source housing chamber, a bottom tunnel and at least two screw holes communicating said light source housing chamber with said bottom tunnel;

a substrate carrying a light-emitting device disposed in said light source housing chamber;

a reflection cover disposed over said substrate;

a watertight upper cover disposed over said reflection cover to be coupled to the upper edge of said light source housing chamber;

two watertight walls connected respectively to said at least two screw holes that pierce through said bottom tunnel for insertion thereinto of at least two screw devices; and a bottom plate for clamping a power strip in said bottom tunnel to enable said two watertight walls to pierce through an insulating casing of said power strip for electrifying said at least two screw devices, whereby said underwater light is provided with a stable power source and an excellent property of watertightness.

2. An underwater light according to claim 1, wherein a sealing gasket is disposed on a coupling part of said watertight upper cover.

3. An underwater light according to claim 1, wherein two insulating bushes are disposed respectively on two screw devices of said at least two screw devices, which are respectively connected to a positive electrode and a negative electrode of said substrate.

4. An underwater light according to claim 1, wherein said watertight upper cover has a watertight cap made of glass.

5. An underwater light according to claim 1, wherein said watertight upper cover has a watertight cap made of plastic.

6. An underwater light according to claim 1, wherein said bottom plate is screwed onto said base by said at least two screw devices.

7. An underwater light according to claim 1, wherein said light-emitting device is a light-emitting diode.

8. An underwater light according to claim 1, wherein said light-emitting device is a light bulb.

* * * * *